US010113345B2

(12) United States Patent
Lahulek

(10) Patent No.: US 10,113,345 B2
(45) Date of Patent: Oct. 30, 2018

(54) COVER OF INSPECTION CHAMBER

(71) Applicant: ROMBA DRYWALL CZ s.r.o., Chudobin (CZ)

(72) Inventor: Roman Lahulek, Bílá Lhota (CZ)

(73) Assignee: ROMBA DRYWALL CZ S.R.O., Chudobin (CZ)

( * ) Notice: Subject to any disclaimer, the term of this patent is extended or adjusted under 35 U.S.C. 154(b) by 327 days.

(21) Appl. No.: 15/041,768

(22) Filed: Feb. 11, 2016

(65) Prior Publication Data

US 2017/0009502 A1 Jan. 12, 2017

(30) Foreign Application Priority Data

Jul. 8, 2015 (CZ) ..... 2015-31299

(51) Int. Cl.
*E05C 19/16* (2006.01)
*E04F 19/08* (2006.01)
*E06B 5/00* (2006.01)

(52) U.S. Cl.
CPC ..... *E05C 19/16* (2013.01); *E04F 19/086* (2013.01); *E06B 5/00* (2013.01)

(58) Field of Classification Search
CPC .... Y10T 292/11; Y10T 24/32; Y10T 16/5401; Y10T 24/27; E05C 19/16; A45C 13/1069; H01F 7/0252; H01F 2007/208; Y10S 52/04; Y10S 428/90; B60R 13/0206; A41F 1/002; A44D 2203/00; A47B 47/042
USPC ..... 292/251.5
See application file for complete search history.

(56) References Cited

U.S. PATENT DOCUMENTS 2,807,841 A * 10/1957 Janos ..... F25D 23/087 24/289
3,124,501 A * 3/1964 Wise ..... B44C 5/0415 24/303
3,434,239 A * 3/1969 Schwenker ..... F25D 17/047 49/478.1
3,455,589 A * 7/1969 Valiulis ..... A44B 18/00 24/442
4,021,089 A * 5/1977 Bush ..... A47B 47/042 312/111
5,117,807 A * 6/1992 Graulich ..... F24C 15/36 126/190
5,535,804 A * 7/1996 Guest ..... E06B 7/32 160/180
6,295,702 B1 * 10/2001 Bauer ..... A45C 13/1069 24/303
2006/0053711 A1 * 3/2006 Vaughan ..... E06B 9/40 52/236.9

(Continued)

FOREIGN PATENT DOCUMENTS

CZ 11397 U1 9/2001
CZ 11976 U1 4/2002

(Continued)

*Primary Examiner* — Mark A Williams
(74) *Attorney, Agent, or Firm* — Bryant J. Keller; Kirton McConkie

(57) ABSTRACT

In accordance with some implementations, a cover of an inspection chamber is described herein. Such a cover can provide a selectively openable and closable cover for covering of openings in walls of buildings or other structures where it is necessary to assure access to air condition devices and distribution of water, gas or electricity, and/or other items. Other implementations are described herein.

20 Claims, 4 Drawing Sheets

(56) References Cited

U.S. PATENT DOCUMENTS

| | | | | |
|---|---|---|---|---|
| 2007/0119548 | A1* | 5/2007 | Anderson | E05D 15/58<br>160/211 |
| 2012/0131854 | A1* | 5/2012 | Pettingill | E06B 7/2316<br>49/478.1 |
| 2015/0283957 | A1* | 10/2015 | Dickinson | F16B 5/123<br>24/303 |

FOREIGN PATENT DOCUMENTS

| | | | |
|---|---|---|---|
| CZ | 13432 | U1 | 8/2003 |
| CZ | 17513 | U1 | 5/2007 |
| EP | 1961891 | | 8/2008 |

* cited by examiner

Fig. 2C
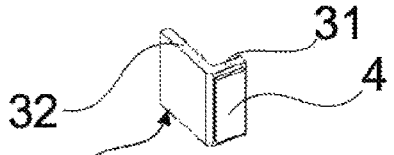
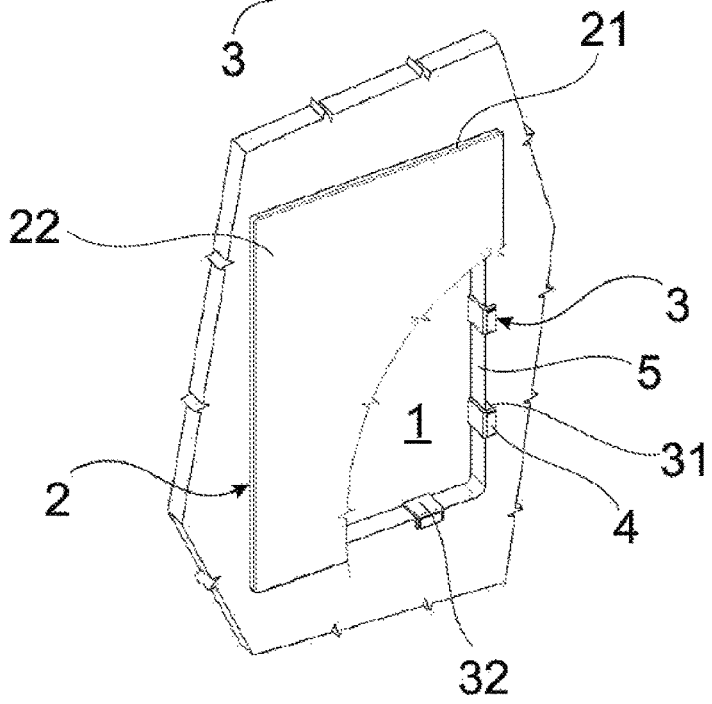
Fig. 2A
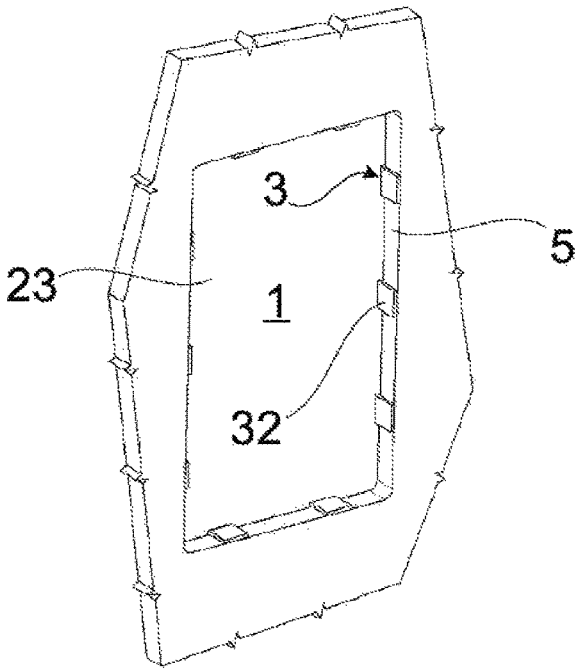
Fig. 2B

Fig. 3C
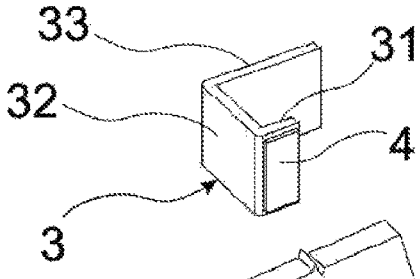
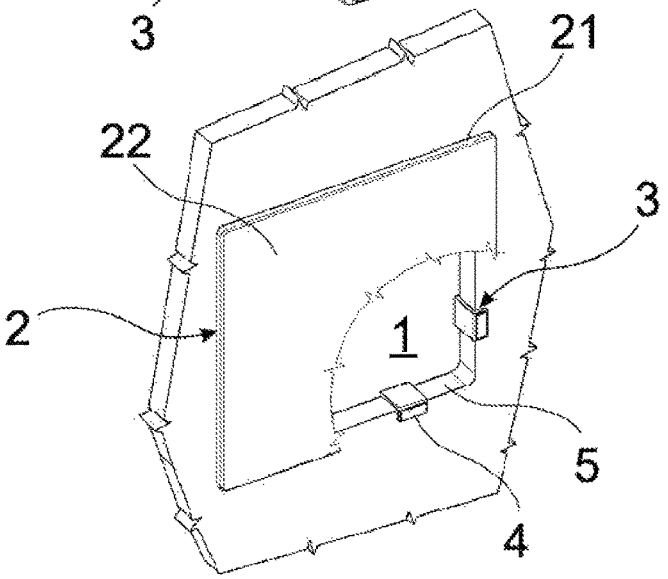
Fig. 3A
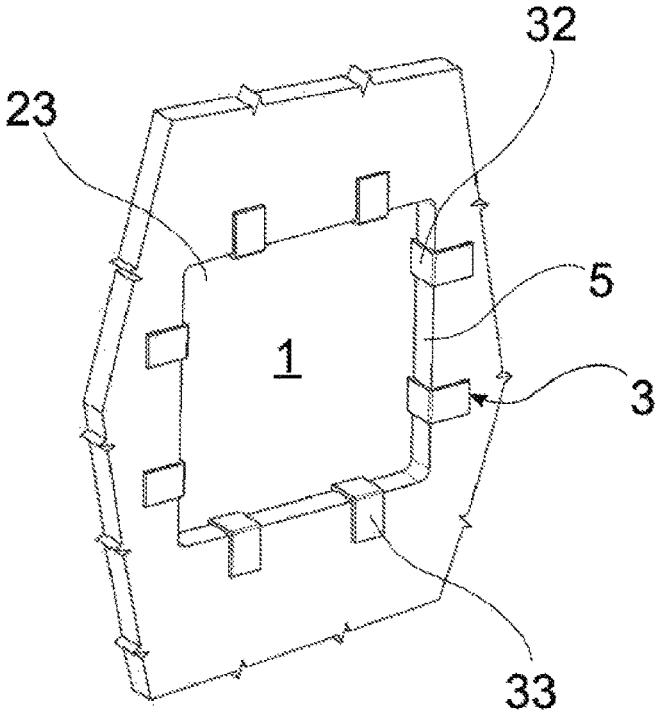
Fig. 3B

COVER OF INSPECTION CHAMBER

FIELD

The described systems and methods relate to several designs of a cover of an inspection chamber, which can be used for covering different devices and apparatuses built in walls, plasterboards, or soffits of buildings or other structures.

BACKGROUND AND RELATED ART

At present, for covering of inspection chambers which are formed in shafts, walls and soffits of buildings, behind which are various water and gas stop valves, checking and metering devices or other apparatuses to which has to be enabled easy access, are used various kinds of covers and doors which are procured with a peripheral frame and a door case. The profiles of the frames especially in bigger doors have a tendency to twist and therefore it may be necessary to attach them to the wall through variety of fixing elements or connecting material in the form of various foams and similar materials. The size stability in some profiles, for example aluminium ones, can be solved with additional steel angles which connect the frames in corners. An example of this design is the inspection door described in the file CZ 11976 U1, where the frame of the door and the door case are formed as a welded piece from aluminium profiles and the mass of the door is from a plasterboard board which is placed in the aluminium frame with which it is connected. A possible disadvantage of this design is assembly of outer frame and consequent locking of the frame. Further examples of design of covers of inspection chambers are known from the files EP 1961891, CZ 13312 U1, CZ 13432 U1 or CZ 17513 U1.

There are likewise known covers of inspection chambers that use systems of magnets fixed on an anchoring perforated metal sheet where the magnets are walled in and the metal sheet is glued to them. A disadvantage of this solution is that during the installment of the magnets these are not always walled in the right height or level and the metal sheet is consequently not glued to the facing in the way for a cover which covers the chamber to join evenly to surrounding surfaces of the facing. Likewise there are known covers which consist of a plastic frame which is procured with adjustable magnets, which is fixed into the anchoring openings by the help of steel anchoring elements which may be necessary to lodge in surrounding walls. A disadvantage of this solution is complicated assembly of the cover where it is necessary to let the anchoring elements solidify properly with fixed frame but this can create time delays. And there is known design of a cover for inspection chamber which is described in the file CZ 11397 U1, where the cover is formed with a magnetically conductive board which is procured on the face side with facing elements and with a frame with fixing elements with height adjustable magnets. The frame is formed with plastic profile elements and profile corners which are demountable connected. This design is relatively easy and fast for assembly, it enables use of various facing elements which can be glued on the magnetically conductive board whereas the joint between the cover and the frame does not have to be filled with any jointing material. A disadvantage of this solution is a difficult structure of the frame and from this resulting expensive production. Finally there is known design of covers of inspection chambers which contain height adjustable magnets which are fixed on fixtures made from a perforated metal sheet which are glued or otherwise fixed to brickwork or a wall. A disadvantage of this design is the fact that the magnets can interfere into the profile of the chamber reducing space for manipulation and furthermore there can come to damage of the fixtures or the magnets during repairs or adjustments of devices built in behind the chamber.

In accordance with some implementations, the aim of the presented technical solution is to offer and implement into use a cover of inspection chamber which would be simple from production point of view, usable into brickwork as well as into plasterboards and at the same time would not necessarily require any accurate placing into the chamber during the assembly.

SUMMARY

Disclosed herein, in accordance with some embodiments, is a cover of an inspection chamber formed with a flat door which is made of a magnetically conductive material and with a set of at least two shaped fixtures made of a flat bar and shaped into the shape of an "L" letter and/or into the shape of a "U" letter where the essence of the invention is in the fact that the fixtures are procured on their face surface of a front arm with flat magnets whereas the door is procured with a ridge, lip, raised edge, protrusion, and/or other welt which is formed in the way that the distance of back wall of the door from its peripheral edge is, in some embodiments, equal to s sum of heights of the front arm of the fixture and the flat magnet.

In accordance with some embodiments, the side arms of the fixtures are formed in the way that their length is smaller or maximally equal to the thickness of the wall of the material in which the chamber is formed whereas in some implementations in which the fixtures are shaped substantially into the "U" letter shape, the length of the side arm between the front arm and the back arm is equal to thickness of the wall of the material of the chamber.

In accordance with some implementations, it can be advantageous when the welt of the door is formed perpendicularly to its front surface or with a slope, which can be about 45° anglewise, or in the form of rounding.

In accordance with some embodiments, the described design is easy to assemble, and usable for chambers formed in brickwork, plasterboards or tile covering, with easy repeated removability of the door.

BRIEF DESCRIPTION OF THE DRAWINGS

Particular examples of the design are schematically illustrated in enclosed drawings where:

FIG. 2A is a frontal axonometric view of the cover from the FIG. 1 with the door in a partial cut and with detailed design of a fixture, in accordance with some embodiments;

FIG. 2B is a back view of the cover from the FIG. 2A, in accordance with some embodiments;

FIG. 2C illustrates a perspective view of one of the fixtures, in accordance with some embodiments;

FIG. 3A is a frontal axonometric view of an alternative design of the cover with a square door, in accordance with some embodiments;

FIG. 3B is a back view of the cover from FIG. 3A, in accordance with some embodiments;

FIG. 3C illustrates a perspective view of one of the fixtures, in accordance with some embodiments;

The drawings which illustrate the presented technical solution and consequently examples of particular designs do not in any case or in any manner limit the extent of the protection mentioned in definition, yet merely clarify some aspects of the described cover.

DETAILED DESCRIPTION

Figure 1A:
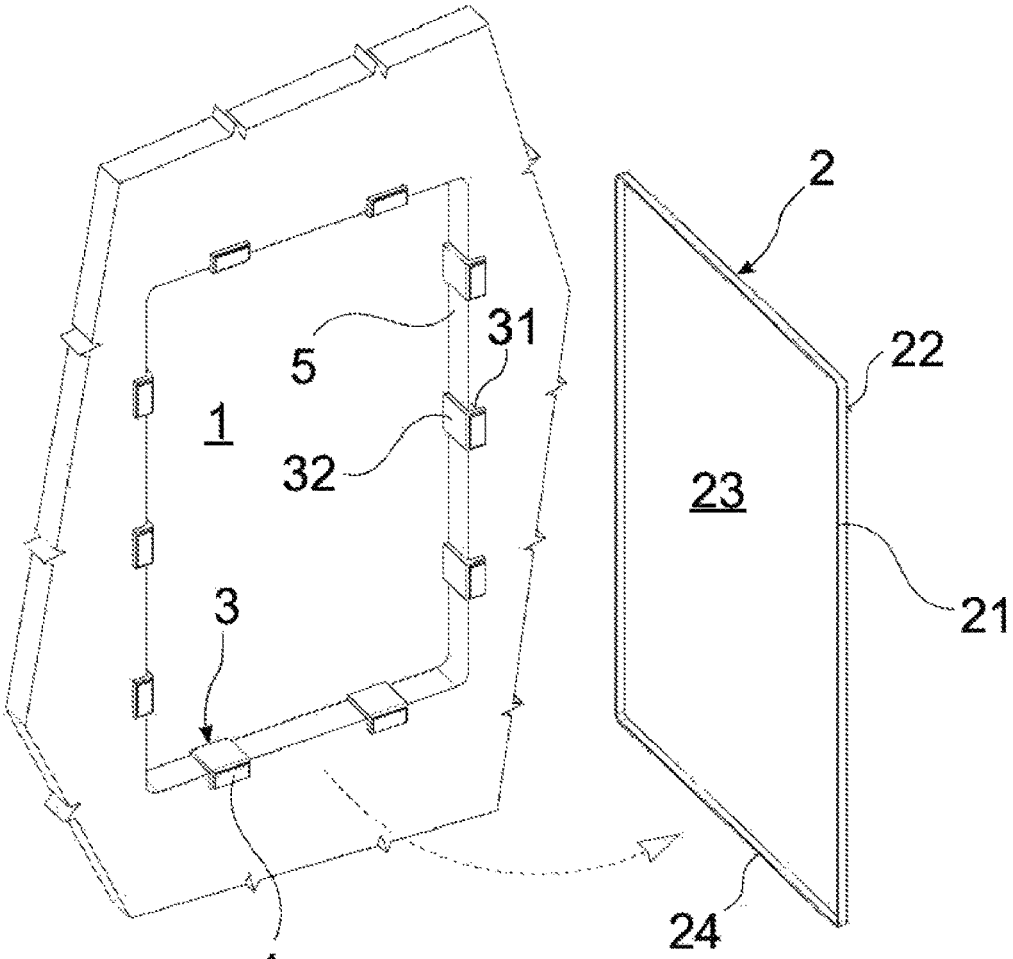
FIG. 1A is an axonometric exploded view of basic design of the cover with a rectangular door and with detailed examples of alternative designs of the welts of the door, in accordance with some embodiments.
Figure 1B:
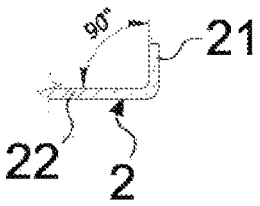
FIGS. 1B-1D illustrate plan views of a welt of the door, in accordance with some embodiments.
Figure 1C:
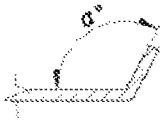
Figure 1D:
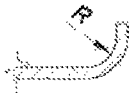

In accordance with some embodiments, a cover of an inspection chamber 1 is in its basic design formed with a flat door 2 which is produced from a magnetically conductive material, by way of non-limiting example a zinc-coated varnished metal sheet which is on its outer surface procured with a non-illustrated foil and a set of shaped fixtures 3. The fixtures 3 are formed from a flat bar and, in some embodiments, are either substantially "L" letter shaped as it is illustrated in FIG. 2A, or substantially "U" letter shaped as it is evident from the FIG. 3A, and are procured on their face surface of a front arm 31 with magnets 4 (which, in some embodiments, are substantially flat), and which (in some embodiments) are on this surface fixed, and in some embodiments glued. In accordance with some embodiments, side arms 32 of the fixtures 3 are formed in the way for their length not to be substantially bigger than is the thickness of the wall 5 of the material—for instance brickwork or plasterboard where the chamber 1 is formed. In some instances in which the thickness of the wall 5 is standardised, for example in plasterboard blocks, the fixtures 3 are formed in the "U" shape in the way that the length of the side arm 32 between the front arm 31 and the back arm 33 is substantially equal to a thickness of the wall 5. In accordance with some embodiments, the door 2 is procured along its whole perimeter with a welt 21, which is either made perpendicularly to its front surface 22 or sloped, including, without limitation, 45° anglewise, or the welt 21 is formed rounded as it is evident from the details of the FIGS. 1B-1D. In some embodiments, the welt 21 is formed in the way that the distance of the back wall 23 of the door 2 form its peripheral edge 24 substantially equals a sum of heights of the flat bar of the front arm 31 of the fixture 3 and the flat magnet 4.

In some embodiments, during assembly of the cover, the fixtures 3 are fixed, for example glued, screwed, or otherwise connected, along the perimeter of the chamber 1 which is formed in the wall 5, then the chamber is covered with the door 2, which is by its back wall 23 fixed to the magnets 4 of the fixtures 3.

Figure 4:
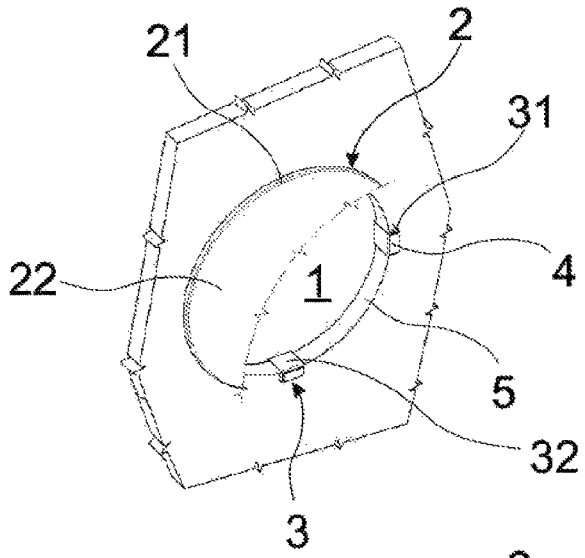
FIG. 4 is an axonometric view of the cover with a circular door for covering of a circular chamber, in accordance with some embodiments.
Figure 5:
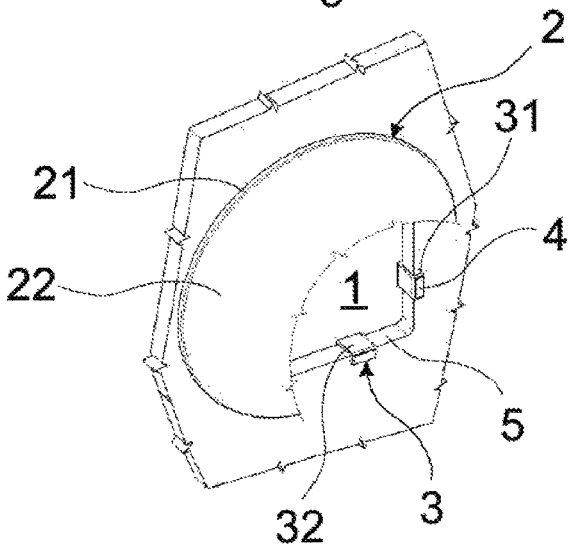
FIG. 5 is an axonometric view of the cover with a circular door for covering of a square chamber, in accordance with some embodiments.
Figure 6:
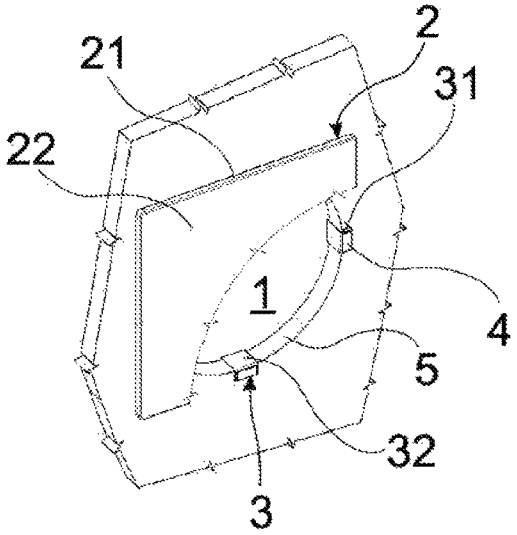
FIG. 6 is an axonometric view of the cover with a square door for covering of a circular chamber, in accordance with some embodiments.

In accordance with some embodiments, the described cover can be designed in any other suitable manner besides those illustrated in FIGS. 1-3. Indeed, depending on the size of the chamber 1 and any other need, the cover's walls 5 can comprise any suitable amount of the fixtures 3. In some embodiments, the cover 1 comprises at least two fixtures. Additionally, in some embodiments, the chamber 1 is circular and can be covered with the circular door 2, as it is illustrated in FIG. 4, or in accordance with some other embodiments, an example of which is illustrated FIG. 5, the square chamber 1 can be covered with the circular door 2. In still another non-limiting example, the circular chamber 1 comprises a square door 2, an embodiment of which is illustrated in FIG. 6.

What is claimed is:

1. A cover system for an inspection chamber, the system comprising:

a door comprising a magnetically conductive material;

a fixture that comprises at least one of an "L" shaped and a "U" shaped object, the at least one of the "L" shaped object and the "U" shaped object each comprising a front arm; and a magnet that is coupled to and disposed on the front arm, wherein the fixture is configured to couple to a wall at an opening in the wall, wherein a perimeter of the door is at least partially defined by a welt, which extends from a portion of the door by a distance that is substantially equal to a sum of a height of the front arm and the magnet, and wherein the magnet on the front arm is configured to magnetically couple to, and to selectively decouple from, the door in a plurality of different locations disposed within the perimeter defined by the welt.

2. The system of claim 1, wherein the at least one of the "L" shaped and the "U" shaped object each further comprise a side arm that extends from the front arm, and wherein a length of the side arm is at least one of smaller and approximately equal to a thickness of a portion of the wall to which the fixture is configured to couple.

3. The system of claim 2, wherein the fixture comprises the "U" shaped object, wherein the "U" shaped object fixture further comprises a side arm and a back arm, wherein the side arm extends between the front arm and the back arm, and wherein a length of the sidearm between the front arm and the back arm is substantially equal to a thickness of a portion of the wall to which the fixture is configured to couple.

4. The system of claim 2, wherein the welt of the door is formed at least one of perpendicularly to a flat surface of the door, at an angle to a portion of the door, and as a rounded lip extending from the door.

5. The system of claim 1, wherein the fixture comprises the "U" shaped object, wherein the "U" shaped object further comprises a side arm and a back arm, wherein the side arm extends between the front arm and the back arm, and wherein a length of the sidearm between the front arm and the back arm is substantially equal to a thickness of a portion of the wall to which the fixture is configured to couple.

6. The system of claim 5, wherein the welt of the door is formed at least one of perpendicularly to a flat surface of the door, at an angle to a portion of the door, and as a rounded lip extending from the door.

7. The system of claim 1, wherein the welt of the door is formed at least one of perpendicularly to a flat surface of the door, at an angle to a part of the door, and as a rounded lip extending from the door.

8. The system of claim 1, wherein the welt of the door is formed to extend substantially perpendicularly to a flat surface of the door.

9. A cover system for an inspection chamber, the system comprising:

a door comprising a sheet of a magnetically conductive material, and a set of at least two fixtures that each comprise an object shaped to into at least one of an "L" shaped object and a "U" shaped object, the at least one of the "L" shaped object and the "U" shaped object each comprising a front arm, wherein a magnet is coupled to and disposed on the front arm of each of the at least two fixtures, wherein the at least two fixtures are each configured to couple to an opening in a wall such that the front arm of each fixture is disposed on and overlaps an external surface of the wall, wherein a perimeter of the door is at least partially defined by a welt, which extends from a portion of the door by a distance that is substantially equal to a sum of a height of the front arm and the magnet such that when the fixture and door are coupled to the wall, the welt extends over and substantially hides the front arm and the magnet of the at least two fixtures, and wherein the magnet on the front arm of the at least two fixtures is configured to magnetically couple to, and to selectively decouple from, the door in a plurality of different locations on the door that are medial to the welt.

10. The system of claim 9, wherein each of the at least two fixtures further comprises a side arm that extends from the front arm, and wherein a length of the side arm is at least one of smaller and approximately equal to a thickness of a portion of the wall to which the each of the at least two fixtures are configured to couple.

11. The system of claim 10, wherein the at least two fixtures each comprise the "U" shaped object, wherein each of the two fixtures further comprise a side arm and a back arm, wherein the side arm extends between the front arm and the back arm, and wherein a length of the sidearm between the front arm and the back arm is substantially equal to a thickness of a portion of the wall to which each of the two fixtures are configured to couple.

12. The system of claim 10, wherein the welt of the door is formed at least one of perpendicularly to a substantially flat surface of the door, at an angle to part of the door, and as a rounded lip extending from the door.

13. The system of claim 9, wherein the at least two fixtures each comprise the "U" shaped object, wherein each of the two fixtures further comprise a side arm and a back arm, wherein the side arm extends between the front arm and the back arm, and wherein a length of the sidearm between the front arm and the back arm is substantially equal to a thickness of a portion of the wall to which each of the two fixtures are configured to couple.

14. The system of claim 13, wherein the welt of the door is formed at least one of perpendicularly to a substantially flat surface of the door, at an angle to part of the door, and as a rounded lip extending from the door.

15. The system of claim 9, wherein the welt of the door is formed at least one of at an angle to part of the door, and as a rounded lip extending from the door.

16. The system of claim 9, wherein the welt of the door is formed to extend substantially perpendicularly to a flat surface of the door.

17. A method for covering an opening in the wall, the method comprising:

providing a cover system for an inspection chamber, the system comprising:

a door comprising a magnetically conductive material;

a fixture that comprises at least one of an "L" shaped and a "U" shaped object, the at least one of the "L" shaped object and the "U" shaped object each comprising a front arm; and a magnet that is coupled to and disposed on the front arm, wherein the fixture is configured to couple to a wall at an opening in the wall, wherein a perimeter of the door is at least partially defined by a welt, which extends from a portion of the door by a distance that is substantially equal to a sum of a height of the front arm and the magnet, and wherein the magnet on the front arm is configured to magnetically couple to, and to selectively decouple from, the door in a first plurality of different locations disposed within the perimeter defined by the welt, coupling the fixture to the wall, the wall comprising a non-magnetically conductive material; and magnetically coupling the door over the opening via the fixture and the magnet, such that the magnet is disposed at a first location on the door.

18. The method of claim 17, wherein the wall comprises at least one of dry-wall, plasterwork, and brickwork.

19. The method of claim 17, wherein the wall comprises dry-wall.

20. The method of claim 17, further comprising: removing the door from the opening and replacing the door over the opening such that the magnet is disposed at a second location on the door, the second location being different than the first location.

* * * * *